United States Patent [19]

Fare

[11] Patent Number: 5,046,873

[45] Date of Patent: Sep. 10, 1991

[54] AUTOMATIC PAPER BAIL ACTUATOR

[76] Inventor: Carlo Fare, Via Dante 116, 20090 Limito, Italy

[21] Appl. No.: 520,583

[22] Filed: May 8, 1990

[30] Foreign Application Priority Data

Jun. 14, 1989 [IT] Italy ..... 20866 A/89

[51] Int. Cl.[5] ..... B41J 13/20

[52] U.S. Cl. ..... 400/639.1; 400/639.2; 400/636; 400/649

[58] Field of Search ..... 400/634, 636, 636.3, 400/637, 637.1, 637.4, 638, 639, 639.1, 639.2, 641, 645, 645.5, 645.4, 649

[56] References Cited

U.S. PATENT DOCUMENTS

| | | | |
|---|---|---|---|
| 2,616,546 | 11/1952 | Maddox | 400/639.1 |
| 4,197,024 | 4/1980 | Huntoon | 400/636 |
| 4,561,792 | 12/1985 | Behrens et al. | 400/639 |
| 4,602,883 | 7/1986 | Ozawa et al. | 400/637.1 |
| 4,630,950 | 12/1986 | Chu et al. | 400/639.1 |
| 4,708,504 | 11/1987 | Asakura | 400/636.3 |
| 4,799,814 | 1/1989 | Okubo et al. | 400/639.1 |
| 4,883,375 | 11/1989 | Karube et al. | 400/638 |

FOREIGN PATENT DOCUMENTS

| | | | |
|---|---|---|---|
| 0013371 | 1/1987 | Japan | 400/636 |
| 0231778 | 10/1987 | Japan | 400/637 |
| 0251172 | 10/1987 | Japan | 400/637 |

OTHER PUBLICATIONS

IBM Tech. Disc. Bulletin, vol. 30, No. 4, 9/87, Platen--Driven Paper Bail Closer.

*Primary Examiner*—Edgar S. Burr
*Assistant Examiner*—Ren Yan
*Attorney, Agent, or Firm*—J. S. Solakian; J. H. Phillips

[57] ABSTRACT

An automatic paper bail actuator for a printer having a rotating platen or equivalent means for feeding a printing support including a helicoidal spring wound on the platen shaft and having two end arms, a first arm being elongated to interfere with the bail and a first reference stop, the spring coil being clamped on the shaft by interference with the bail and opening the bail when the shaft rotates in the direction opposite to the one providing normal forward feeding of a printing support, closing the bail when the shaft rotates in the direction providing normal forward feeding until the first arm interferes with the first reference stop and releases the spring coils; the second arm interfering with a second reference stop for a rotation of the shaft in the direction opposite to the normal one and releasing the spring coils for a predetermined angular position of the spring and the first arm, hence for a predetermined open position of the bail. Additional structure providing hysteresis between the open and closed positions of the bail are also disclosed.

4 Claims, 2 Drawing Sheets

AUTOMATIC PAPER BAIL ACTUATOR

FIELD OF THE INVENTION

The present invention relates to an automatic paper bail actuator for printers or electronic typewriters.

BACKGROUND OF THE INVENTION

It is known that in modern computer printers and electronic typewriters, single paper sheets are fed by a rotating platen which cooperates with pressure rollers to convey the paper sheet to a zone where printing devices (generally a printing head reciprocating along guiding bars) perform the printing of a character row. To assure a good printing quality, it is required that the paper sheet to be kept adherent to the platen in the printing zone. To this purpose, pressure rollers are provided positioned along a generatrix of the rotating platen and downstream of the printing zone. These rollers press the paper against the platen. The rollers are idler mounted on a rod which is parallel to the platen axis and is provided with two ending arms, perpendicular to the rod and hinged to the printer side plates, so that the rod and the rollers mounted thereon can be alternatively moved well away from the platen and again brought in contact with the platen. In other words this structure (known as a "bail") can be opened and closed.

The rod is normally urged toward the platen by resilient means. For the correct insertion of a sheet in the printer, the bail must be opened so that the sheet may be wrapped around the platen up to the line of contact between the platen and the paper bail rollers. Then, the bail must be closed so that the pressure rollers keep the sheet in contact with the platen. In the past, bails were manually operated. In modern printers, automatic actuators are provided which include control electromagnets or mechanical devices actuated by motor members already present in the printer (such as the carriage motor or the paper feeding motor which rotates the platen). An example of such devices is described in European Patent Application EP-AS-0216394. All these devices are very complex and expensive. The present invention overcomes these disadvantages and provides an automatic paper bail actuator which is reliable, extremely simple and inexpensive.

SUMMARY OF THE INVENTION

The automatic paper bail of the invention uses the platen movement as a motion source and essentially includes a coil spring wrapped around the platen shaft and having two ending arms. When the platen shaft rotates, the spring follows the shaft rotation until the upstream arm (upstream with reference to the shaft direction of rotation) interferes with a stopping member. Owing to such interference, the spring coils tend to increase their diameter and release their gripping action on the shaft, which is free to rotate. As long as the coil spring is gripping the shaft, the downstream arm may exert a driving torque on other elements, particularly the bail and thus opening it. For rotation of the draft in the reverse direction, an opposite action occurs and the bail may be closed. According to a further aspect of the invention, a suitable hysteresis of the bail movement relative to the platen shaft movement is obtained by means of a second coil spring wrapped around a fixed post or by means of a cam.

DESCRIPTION OF THE DRAWING

The features and the advantages of the invention will become more readily apparent from the following description of a preferred form of embodiment and the enclosed drawings where.

DETAILED DESCRIPTION OF THE INVENTION

Figure 1:
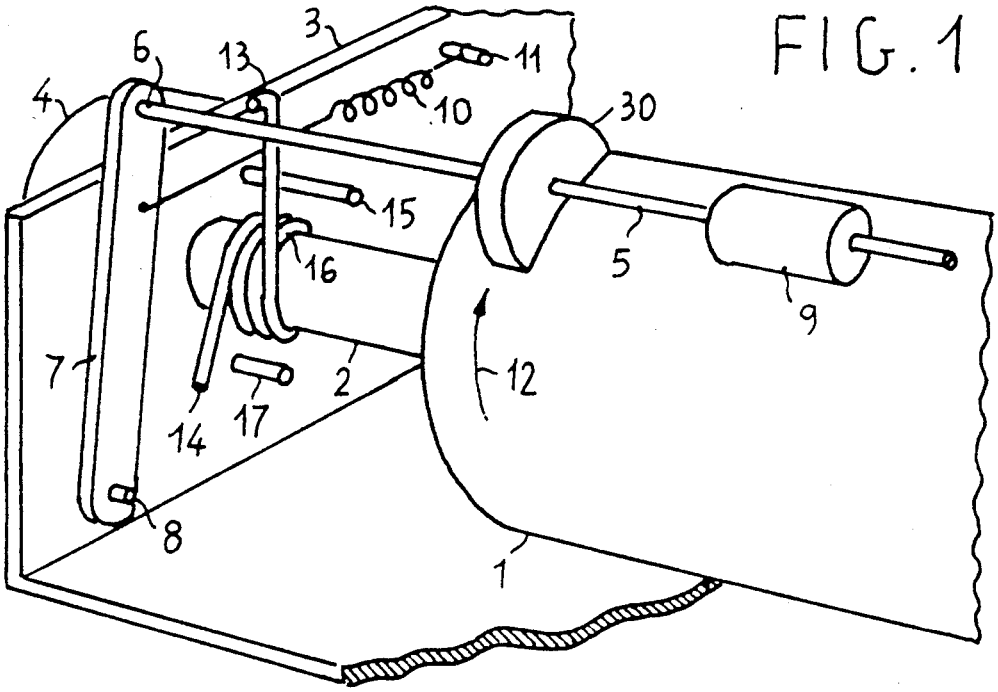
FIG. 1 is a perspective view of a portion of a printer provided with a preferred embodiment of the automatic paper bail actuator according to the present invention.

Referring to FIG. 1, there is shown a perspective view of a portion of a printer provided with the automatic paper bail actuator of the invention. A rotating platen 1 is keyed on a shaft 2 which pivots on two side plates. Only one of such side plates, referenced by numeral 3, is shown in FIG. 1. A motor 4 drives shaft 2, directly or through suitable gearing, and thus controls rotation of the platen. The bail consists of a rod 5 positioned parallel to the platen axis and having one end 6 fixed to a free end of an arm 7. Arm 7 is hinged at its other end on a pivot 8 which is fixed to side plate 3. The other end of rod 5, not shown in FIG. 1, is fixed to a free end of another arm similar to arm 7 and hinged to a pivot fixed to the other side plate.

Paper pinching rollers, one of which is shown and referenced by numeral 9, are idler mounted on rod 5. A pull spring 10 (or other equivalent means) having an end fixed to arm 7 and the other end hooked to a pin 11, on side 3, urges the rod 5 towards the platen so that the pinching rollers are in contact with the platen. The normal rotational direction of the platen, for feeding a printing support, is the one indicated by arrow 12. With reference to the view of FIG. 1, this rotation is clockwise.

According to the invention a coil spring 16 is wrapped around shaft 2. The spring coils have an inner diameter equal or slightly less than the shaft diameter so as to grip the shaft and follow it in rotation, owing to friction. The spring 16 is terminated with two arms 13, 14 which extend approximately radially from shaft 2. Arm 13 extends from the spring in the normal or direct rotational direction of the platen and has a length sufficing for interference with rod 5 in the course of its rotation around shaft 2. Arm 14 extends from the spring 16 in the reverse rotational direction of the platen.

A first pin 15 (or other equivalent element), fixed to side plate 3, provides a stop and rest point for arm 13 and prevents rotation of the coils of spring 16 and arm 13 in the direct direction beyond the predetermined point established by pin 15. A second pin 17, fixed on side plate 3, at a suitable position, provides a stop and rest point for arm 14 and prevents rotation of the coils of spring 16 and arm 14 in the reverse direction beyond the predetermined limit established by pin 17.

When shaft 2 rotates in the direct direction, the spring 16 follows the shaft movement until arm 13 interferes with pin 15. At this point, the resisting torque exerted by arm 13 on spring 16 tends to widen the coils, and the spring 16 stops its rotation and slides on the shaft without preventing its rotation. When shaft 2 rotates in the reverse direction, spring 16 follows the shaft movement until arm 13 interferes with rod 5. At this point the resisting torque exerted by arm 13 on spring 16 tends to grip the spring coils. The spring continue to turn with shaft 2, and, by so doing, it drives rod 5 away from the platen and opens the bail. The opening action continues until arm 14 interferes with pin 17. At this point, resisting torque exerted by arm 14 on spring 16 tends to widen the spring coils, and spring 16 stops rotating and slides on shaft 2 without preventing its reverse rotation.

Owing to the combined action of arms 14 and 13, the spring 16 rests in a stable position in which the bail is kept open, and the bail remains open even if reverse rotation of shaft 2 is stopped. If shaft 2 is rotated in the forward direction, the action of arm 14 on the spring is ended, but not the action of arm 13. Consequently, the spring 16 turns with the shaft 2, and the bail is allowed to return to its closed position. It is therefore clear that by rotating shaft 2 and the platen in the reverse and forward directions, the bail may be opened and closed automatically, and the operation may be controlled by a suitable energization control routine for motor 4.

Figure 2:
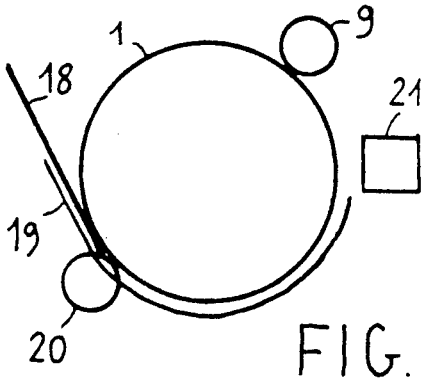
FIGS. 2 to 5 show, in sketched side view and in sequence, the several operative phases of a paper bail provided with the automatic actuator of FIG. 1.
Figure 3:
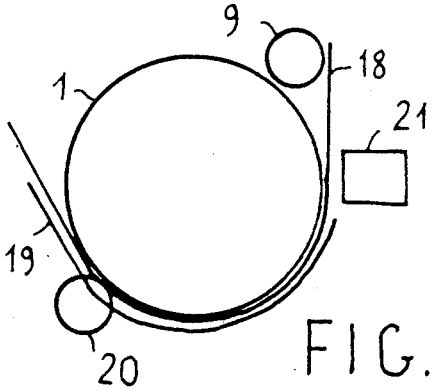
Figure 4:
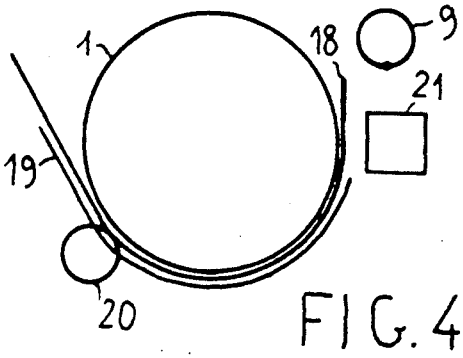
Figure 5:
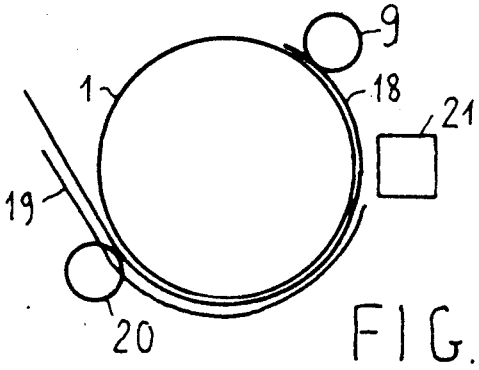

FIGS. 2 to 5 show, in sketched side view, the operative sequence for loading a sheet in the printer and the automatic actuation of the bail. In FIG. 2, the platen 1 is ready to receive a paper sheet 18 which is inserted, manually or by means of automatic feeding devices (not shown), between a feeding guide 19 and platen 1 until the leading edge of the sheet rests on pressure rollers 20, always in contact with the platen 1. By rotating the platen in the forward direction, the sheet 18 is pinched between rollers 20 and platen 1 and is driven up to the printing line defined by the location of printing members 21 (generally the platen generatrix defined by a vertical plane tangent to the platen). By continuing to forwardly rotate the platen (FIG. 3), the paper sheet rises vertically and rigidly up to the height of the bail rollers 9, which is in the closed position.

The paper forward feed is continued until the leading edge of the paper sheet is substantially at the same distance from the printing elements as the axis of the rollers from the printing elements. Since the bail is closed and the rollers 9 are in contact with the platen, the rollers are interposed between the platen and paper sheet. At this point (FIG. 4), the platen is rotated in the reverse direction through a predetermined angle. Owing to such rotation, the paper sheet is drawn back, and its leading edge is lowered. At the same time, thanks to the automatic bail actuator, the bail is opened and takes the position shown in FIG. 4, forward of the vertical plane in which the paper sheet leading edge is located. In the course of the opening of the bail, a certain interference may occur between the leading edge of the sheet and the rollers 9. Due to such interference, the leading edge is temporarily bent well away from the platen. The interference ends as soon as the sheet is drawn back of a predetermined amount.

At this point (FIG. 5), the platen is rotated in the forward direction through the same angle of reverse rotation or even through a greater angle. Due to such rotation, the paper sheet is fed forward and raises vertically again. At the same time the bail is closed again. The two combined movements cause a new interference of the leading edge with the rollers. However, in this case, the rollers acts by bending the paper and pushing the leading edge against the platen. When the bail is completely closed, the sheet is correctly interposed between the platen and the pressure rollers.

Figure 6:
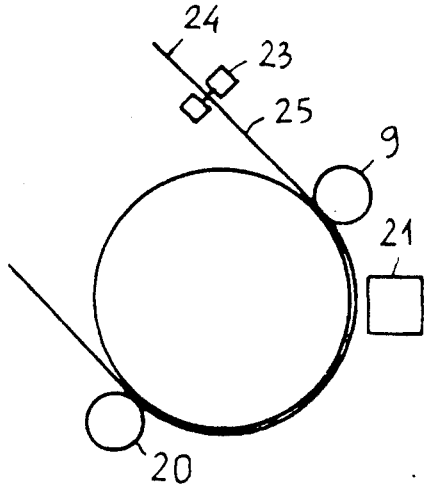
FIG. 6 shows, in sketched side view, a paper bail provided with the automatic actuator of FIG. 1 as a device in support of the "zero tear off" functionality.

It is clear that the automatic paper bail actuator of the invention is useful not only for the automatic loading of single sheets in the printer, but even for obtaining the so called "zero tear off" functionality. This functionality is needed when continuous forms (instead of single sheets) are used, and is obtained, as shown in FIG. 6, by advancing a continuous form portion, where printing has been performed, beyond a cutting ruler 23. Thereafter, the cutting ruler 23 may be actuated thus severing the printed module portion 24 from the module portion 25 located upstream of ruler 23.

To avoid paper waste, it is an advantage to perform the printing operation even on the printing module portion which is just upstream of the ruler 23. This is achieved by drawing back the module, by reverse rotation of the platen, until the upper edge of the module is aligned with the printing line. By this operation, the bail is automatically opened and is reclosed when the module is forward fed again (between the printing operation of a given line and the next line). When the bail is closed, the module is again correctly interposed between the platen and the pressure rollers 9.

Without developing complex considerations of a geometrical nature, it may be noted that the automatic paper bail of the invention is effective in a very broad range of platen 1 diameters, roller 9 diameters, distance of the rollers from the printing line and lever arm length of rod 5. It is further possible to broaden the range by simple arrangements which introduce some hysteresis into the paper bail movement with respect to platen rotation.

Figure 7:
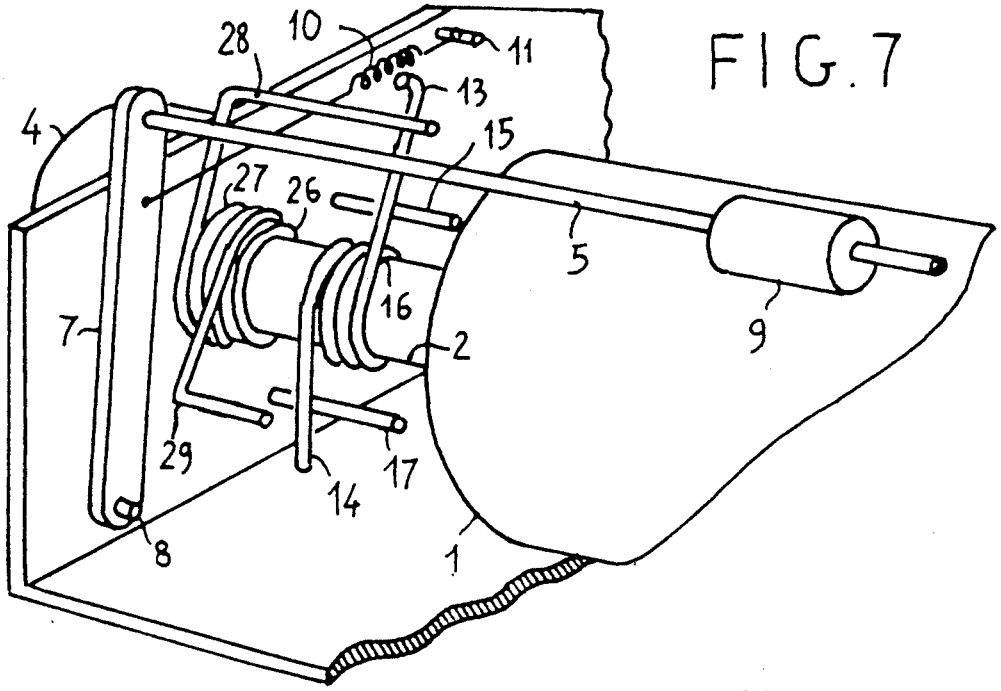
FIG. 7 shows, in perspective view, a portion of a printer provided with another embodiment of an automatic paper bail actuator in accordance with the present invention.

FIG. 7 shows, in perspective view, an embodiment of the automatic actuator of FIG. 1 which includes a preferred form of a hysteresis element. In FIG. 7, in addition to the several elements already considered with reference to FIG. 1 (which in FIG. 7 are identified by the same reference numerals), there is provided a sleeve 26 which is fixed with side plate 3 and acts as a bushing for shaft 2. A second coil spring 27 is wound on sleeve 26. Coil spring 27 has two suitably shaped ending arms 28, 29. Arm 28 is bent so as to interfere with arm 13 for a predetermined angular position of arm 28 on sleeve 26 and of arm 13 on shaft 2, respectively. Arm 28 is further capable of interference with bail rod 5. Arm 29 is bent so as to interfere with arm 14 for a predetermined angular position of the two arms on sleeve 26 and shaft 2, respectively. The angle formed by the two arms 28 and 29 relative to the axis of spring 27 differs from the one formed by the two arms 13, 14 and is such that when the two arms 13, 28 interfere, the arm 29 is leading as to arm 14 in the direction of forward rotation of spring 16.

The position of pin 15, which defines the maximum forward rotation of spring 16, is established so that arm 13 exerts its opening action on the bail only after a suitable reverse rotation of the platen. The operation of the described actuator is very simple. A forward rotation of the platen causes rotation of spring 16 until arm 13 interferes with pin 15, preventing any further rotation of spring 16. Rotation of spring 16, hence of arm 14, causes interference with arm 14 with arm 29 and imposes a rotation of spring 27 and arm 28. Arm 28 takes a rest position in which it is in contact with rod 5 and the bail is closed. A first phase of reverse platen rotation brings arm 13 to interfere with rod 5 and arm 28 without opening the bail. A second phase of reverse platen rotation causes the bail opening and, at the same time (due to interference of arm 13 with arm 28), a reverse rotation of spring 27 on sleeve 26. This rotation is allowed because the coils of spring 27 tend to be widened. The maximum reverse rotation of spring 16, and consequently of spring 27, is determined by the position of pin 17.

Once the bail is open, the closing occurs in two phases. In a first phase of forward platen rotation, spring 16 rotates with the platen, and arm 13 moves away from rod 5. However, the bail does not close because rod 5, by pushing on arm 28, tends to grip the coils of spring 27 on sleeve 26. Thus, spring 27 is locked in position, and arm 28 prevents the bail closing. In a second phase of forward platen rotation, the arm 14 of spring 16 interferes with arm 29 of spring 27 and tends to widen the coils of spring 27. Thus, spring 27 yields and also rotates in the forward direction. The bail, which is no longer hindered by arm 28, closes, and springs 27, 16 take the position of maximum forward rotation allowed by pin 15.

Therefore, the opening and the closing of the bail occurs with a delay as to the platen rotation. By this delay, the interference of the rollers with the paper sheet previously fed at the same height of the rollers, or more, is prevented in the opening phase. In the closing phase the delay assures that the bail is closed when the paper sheet has been already fed forward and is interposed between platen and rollers.

It is clear that FIG. 1 and 7 show preferred forms of embodiments and that several changes can be made. For instance, the arms 15 and 28 of the springs may act on arm 7 of the bail. The spring 27 may be wrapped around a sleeve or a post fixed to side plate 3 and not necessarily coaxial to shaft 2. In particular, by suitable shaping of arms 28, 29 the spring 27 may be wrapped around pin 8, which acts as pivot for bail arm 7. The hysteresis between platen rotation and bail closing may be further obtained with means other than the described ones. FIG. 1 shows, inserted on bail rod 5, a spacer 30 which is free to rotate on rod 5. Spacer 30 has the shape of a cylindrical segment, having a diameter greater than that of the pressure rollers 9 and a chord at a distance from the segment axis which is less than the radius of the rollers 9. The spacer 30 is juxtaposed to an end portion of the platen, and its flat surface is normally oriented towards the platen surface. In this state, a platen rotation in either the forward or reverse direction does not cause any change in the position of the spacer. However if the rod 5 is moved away from the platen (because actuated by spring 16), the spacer rotates by gravity and its flat surface orientates upward. In this position the spacer rests against the platen and prevents the bail from closing.

If the platen is rotated, the friction between the spacer and the platen causes a rotation of the spacer until the flat surface orientates again toward the platen and allows the bail to close. Thus, the bail closes with a delay as to rotation of the platen. It is clear that the shape of the spacer may be changed and may take the form of a cylindrical sector or lunette and more generally of a revolving cam, normally inactive and capable of taking an active position when rod 5 is moved apart from the platen.

Figure 8:
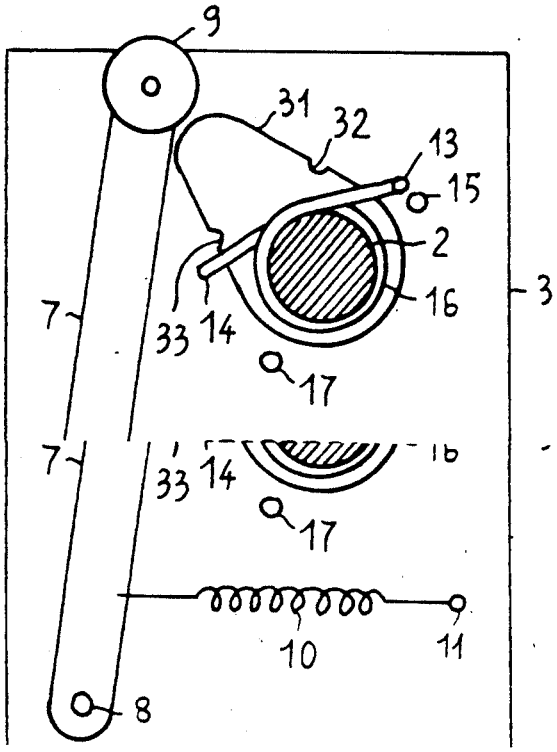
FIG. 8 shows, in sketched side view, a further embodiment of automatic paper bail actuator in accordance with the present invention.

FIG. 8 shows a further embodiment of the automatic paper bail actuator with hysteresis. An idle cam 31 is inserted on shaft 2 and has two notches 32, 33 for receiving the arms 13, 14, respectively, of spring 16, in a mutually exclusive way. Cam 31 pushes with its active profile against bail arm 7. When shaft 2 rotates in the reverse direction, the arm 13 enters notch 32 and causes rotation of the cam 31 which acts on arm 7 and opens the bail with some delay. When arm 14 interferes with pin 17, spring 16 yields, and the cam 31 is in a stable position which prevents the bail from closing.

During a first phase of forward rotation of shaft 2, spring 16 rotates with the shaft without causing rotation of the cam 31 until arm 14 enters notch 33. Then, spring 16 starts to rotate the cam which moves from the stable position to an instable one, thus allowing the bail to close.

In the preceding description, reference has been made, for sake of clarity, to a printer having a rotating platen where the members which act on the printing media to move it provide a surface against which the printing operation is performed. It is clear, however, that the two functions can be performed by two distinct elements: for instance a steady platen and one or more feeding rollers located downstream from the platen (having regard to the normal advancement direction of the printing support) and cooperating with pressure rollers mounted on a bail which must be opened and closed for an easier insertion of the printing support. It is clear that the automatic actuator of the invention may be used in this case too.

In addition, the automatic actuator of the invention may be advantageously used not only for the loading and positioning of single sheets or for the "zero tear off" functionality, but also for the handling of fanfolded continuous forms. It is known that fanfolded continuous forms, in case of multiple copy forms or supports for labels, are relatively rigid. In this case, when the folded zone approaches the pressure rollers of the bail, the form has difficulty in inserting between the platen and the rollers. By temporarily releasing the bail, the insertion is made easier and further enables for the recovery of relative offsetting among the several copies of the form.

What is claimed is:

1. An automatic paper bail actuator for a printer having a frame and a driving shaft mounted thereon, at least one paper feeding roller coupled to said driving shaft, a bail rod having pressure rollers mounted thereon and cooperating with said feeding roller for guiding the movement of a printing support downstream of a printing line, said actuator comprising:

a first helicoidal spring having coils wound on said shaft and having an inner diameter not exceeding the diameter of said shaft so that a rotation of said shaft normally causes a corresponding rotation of said coil, said spring having a first and a second ending arm, a first stop member mounted on said frame, interfering with said first ending arm and causing the release of said spring coils when said shaft rotates in a first direction such as to cause a forward feeding of said printing support, a second stop member mounted on said frame, interfering with said second ending arm and causing the release of said spring coils when said shaft rotates in the reverse direction opposite to said first direction, said first and second stop members being located on said frame so as to allow a predetermined rotation of said coil in both said directions, owing to rotation of said shaft, said first ending arm acting on said bail to cause the opening of said bail when said shaft rotates in said reverse direction and acting on said bail to enable its closing when said shaft rotates in said first direction.

2. The automatic paper bail actuator of claim 1 further including hysteresis means, said hysteresis means comprising a cylindrical member fixedly mounted on said frame, a second helicoidal spring having coils wound on said cylindrical member and having its axis parallel to said shaft, the coils of said second spring having an inner diameter not exceeding the outer diameter of said cylindrical member so as to be normally steady with said cylindrical member, said second spring having a first and second ending arms, said second spring first arm interfering with said first spring first arm and causing the release of said second spring coils when said first spring rotates in said reverse direction, said second spring second arm interfering with said first spring second arm when said first spring rotates in said first direction, said second spring first arm further interfering with said bail and preventing its closing until said first spring second arm interferes with said second spring second arm causing the release of said second spring coils and enabling rotation of said second spring on said cylindrical member.

3. An automatic bail actuator according to claim 1 further comprising hysteresis means including a cam idly mounted on said bail rod, said cam having an active profile and an inactive profile, said cam facing said paper feeding roller, and being sized so as to enable the closing of said bail and the contact of said bail pressure rollers with said paper feeding roller, when said inactive profile is interposed between said bail rod and said paper feeding roller, said bail being kept open by the interference of said cam with said paper feeding roller when said active profile is interposed between said bail rod and said paper feeding roller, a rotation of said paper feeding roller causing a rotation of said cam, as long as said cam interferes with said paper feeding roller.

4. An automatic bail actuator according to claim 1 comprising hysteresis means including a cam idly mounted on said shaft and having first and second interference surfaces respectively with said first and second arms, the interference of said first arm with said first surface, owing to rotation of said shaft in said reverse direction, causing rotation of said cam in said reverse direction, the interference of said second arm with said second surface, owing to rotation of said shaft in said first direction, causing rotation of said cam in said first direction, said first arm acting on said bail through intermediation of said cam.

* * * * *